US006662598B2

(12) United States Patent
Meehan

(10) Patent No.: US 6,662,598 B2
(45) Date of Patent: Dec. 16, 2003

(54) BODY ORNAMENT

(76) Inventor: Theresa Meehan, P.O. Box 528, Ardmore, PA (US) 19003

( * ) Notice: Subject to any disclaimer, the term of this patent is extended or adjusted under 35 U.S.C. 154(b) by 0 days.

(21) Appl. No.: 09/949,357

(22) Filed: Sep. 7, 2001

(65) Prior Publication Data

US 2002/0033029 A1 Mar. 21, 2002

Related U.S. Application Data

(60) Provisional application No. 60/233,604, filed on Sep. 18, 2000.

(51) Int. Cl.[7] ..... A44C 7/00

(52) U.S. Cl. ..... 63/12; 63/13; 63/14.1; 63/14.5; 63/14.8; 24/551; 24/552

(58) Field of Search ..... 63/12, 13, 14.1, 63/14.4, 14.5, 14.8; 24/509, 489, 499, 500, 510, 551, 552, 553, 554

(56) References Cited

U.S. PATENT DOCUMENTS

| | | | | | |
|---|---|---|---|---|---|
| 71,457 | A | * | 11/1867 | Cooper | 24/551 |
| 93,456 | A | | 8/1869 | Lines | |
| 107,679 | A | | 9/1870 | Haberland | |
| 180,430 | A | * | 8/1876 | Lambert | 24/551 |
| 685,974 | A | | 11/1901 | Cote | |
| 1,176,210 | A | * | 3/1916 | Farley | 24/560 |
| 1,684,783 | A | | 9/1928 | Spear | |
| 2,147,731 | A | * | 2/1939 | Bennett | 24/343 |
| 2,166,533 | A | | 7/1939 | Oettel | |
| 2,383,448 | A | | 8/1945 | Christy | |
| 2,869,338 | A | | 1/1959 | Norgaard et al. | |
| 3,739,599 | A | | 6/1973 | Melone | |
| 4,107,824 | A | | 8/1978 | Lussier | |
| 4,129,998 | A | | 12/1978 | Ferro | |
| 4,324,025 | A | * | 4/1982 | Apri | 24/552 |
| 4,411,050 | A | | 10/1983 | Couture | |
| 4,625,526 | A | | 12/1986 | Milawski | |
| 4,987,667 | A | | 1/1991 | Zwart | |
| 5,125,244 | A | | 6/1992 | Zwart | |
| 5,217,464 | A | * | 6/1993 | McDonald | 606/107 |
| 5,301,393 | A | | 4/1994 | Brown | |
| 5,499,431 | A | * | 3/1996 | Mortensen et al. | 24/543 |
| 5,803,096 | A | | 9/1998 | Lee | |
| 5,979,021 | A | * | 11/1999 | Swift | 24/66.6 |
| 6,082,138 | A | * | 7/2000 | Meehan | 63/14.8 |
| 6,389,656 | B1 | * | 5/2002 | Pellikaan | 24/326 |

FOREIGN PATENT DOCUMENTS

| | | |
|---|---|---|
| FR | 133927 | 12/1879 |
| FR | 1580355 | 9/1969 |
| GB | 19730 | 2/1912 |

OTHER PUBLICATIONS

Hairclip, photos attached, publication date unknown.

* cited by examiner

*Primary Examiner*—Andrea Chop
(74) *Attorney, Agent, or Firm*—Akin Gump Strauss Hauer & Feld, L.L.P.

(57) ABSTRACT

A body ornament has first and second positioning arms that are pivotally connected together. The first positioning arm crosses the second positioning arm at first and second crossing points. A generally elongated loop is formed between the crossing points for receiving the body part. The size of the loop is adjustable by pivoting the positioning arms either toward or away from each other. The positioning arms are preferably biased toward each other so that a minimal loop size is initially formed. In one embodiment, the pivot joint between the first and second positioning arms includes a pivot pin. A loop is formed at one end of the pin for receiving a decorative item. In a further embodiment, the pivot joint is in the form of an integral hinge that biases the first and second positioning arms toward each other.

20 Claims, 5 Drawing Sheets

BODY ORNAMENT

CROSS REFERENCE TO RELATED APPLICATIONS

This application claims the benefit of U.S. Provisional Application No. 60/233,604 entitled "BODY ORNAMENT", filed Sep. 18, 2000.

BACKGROUND OF THE INVENTION

This invention relates to personal ornamentation, jewelry, decorations and the like, and more particularly, to such ornamentation, jewelry and decorations which are positioned or carried directly by a body part of a person.

Human beings have been adorning their body parts with jewels, decorations and other ornamentation for centuries. One such common form of body ornamentation are earrings which are directly carried by, hang from, or are otherwise positioned on, an ear or both ears of a person instead of being attached, for instance, to their clothing. It is quite common for persons who desire to wear earrings to have an ear or both ears pierced in one or more places to accommodate positioning the earring or earrings. However, once pierced the person has to position an earring part in the opening through the ear or the opening will close. Piercing of other body parts to attach jewelry, decorations or other ornamentation's thereto has also become commonplace. Lips, noses, breast nipples, and other body parts once pierced also require placement of an ornament, decoration or other item through the pierced opening or the opening may close and require re-piercing.

Many people, however, do not wish to have their body parts pierced because of problems with keeping the pierced opening open. There are also concerns with possible health hazards due to having a pierced body part, from the body part piercing, and possible discomfort from either always wearing an ornament or whatever is utilized to keep the pierced opening open.

There are, however, earrings which do not require piercing the ear to facilitate wearing an earring. Clip-like or clasp-like arrangements such as those shown and described in U.S. Pat. No. 1,684,783 patented to R. Spear on Sep. 18, 1928 for "Ear Ornament"; in U.S. Pat. No. 2,383,448 patented on Aug. 28, 1945 to C. Christy for "Ear Ornament"; in U.S. Pat. No. 3,739,599 patented on Jun. 19, 1923 to A. Malone for "Resilient Earring Including Means Limiting Pressure On the Ear Lobe"; and in British Letters Patent Number 19,730 patented on Feb. 1, 1912 to A. Halliday for "Improvements In Or Relating To Earrings", are known. However, all of these arrangements require the use of body gripping members which engage the body part over a relatively small area and which, therefore, may apply an unacceptable positioning pressure to the body part that results in discomfort to the wearer. Moreover, these body part-gripping arrangements are peculiar to earrings and would most likely be unacceptable to position an ornament or decoration on other body parts such as breast nipples. Examples of body decoration or ornamentation, particularly for positioning on the nipple of a person's breast, are shown and described in U.S. Pat. No. 4,987,667 patented to H. Zwart on Jan. 29, 1991 for "Method of Decorative A Human Breast" and in U.S. Pat. No. 5,125,244 patented on Jun. 30, 1992 to H. Zwart for "Nipple Ring For Decorating A Human Breast". Both of these patents require use of a clamping collar of the type shown and described in U.S. Pat. No. 4,107,824 patented to M. Lussier on Aug. 22, 1978 for "Clamping Collar" which encircles the nipple and may apply too much pressure around the entire nipple. Human breast nipples, like other human body parts, differ in size and shape. The Zwart nipple ring may prove unacceptable because if the smallest size to which the ring closes is still larger than the particular nipple upon which it is to be positioned the ring will fall off; and if the nipple ring closes to a size smaller than the users nipple then possible unacceptable pressure will be applied around the entire nipple creating discomfort to the wearer and/or distortion of their nipple's shape. In addition, squeezing the end pieces of the Zwart devices between ones fingers and manipulating the device over a nipple while resisting the built in spring effect to close the opening may prove to be troublesome and thus render the type of decoration and positioning unacceptable. D. Milawski, on the other hand, in U.S. Pat. No. 4,625,526 patented on Dec. 2,1986 for "Nipple Decoration Device" provides spring biased arcuate pads for positioning a decoration on a human breast nipple. Here again the possible separation between the arcuate pads if too small may create a painful experience and if too large will result in the decoration not being able to stay on. Moreover, keeping the pads separated while positioning the device on a nipple appears to create some degree of difficulty. Separating the pads once the device is in place may present even greater problems.

SUMMARY OF THE INVENTION

According to the invention, a body ornament comprises a first positioning arm having first and second portions and a second positioning arm having first and second portions. The first portion of the first positioning arm is connected to the first portion of the second positioning arm, with the first positioning arm crossing over the second positioning arm at a first crossing point and at a second crossing point. The first and second positioning arms form a generally elongated loop between the first crossing point and the second crossing point for receiving a body part. The second portions of the first and second positioning arms are movable between a first position wherein the loop is a first size and a second position wherein the loop is a second size which is larger than the first size. Preferably, the second portions are biased toward the first position. A first stop tab is located on one of the first and second positioning arms for holding the second portions of the first and second positioning arms in the first position.

Further according to the invention, a body ornament comprises a first positioning arm having first, second and third portions, and a second positioning arm having first, second and third portions. The first portion of the first positioning arm is connected to the first portion of the second positioning arm, with the first positioning arm crossing the second positioning arm at a first crossing point and at a second crossing point. The first and second positioning arms form a generally elongated loop between the first crossing point and the second crossing point for receiving a body part. The second portions of the first and second positioning arms are movable between a first position wherein the loop is a first size and a second position wherein the loop is a second size which is larger than the first size. Preferably, the second portions are biased toward the first position, with the third portions of the first and second positioning arms extending beyond the second crossing point from the second portions of each positioning arm.

BRIEF DESCRIPTION OF THE SEVERAL VIEWS OF THE DRAWINGS

The foregoing summary as well as the following detailed description of the preferred embodiments of the invention will be better understood when read in conjunction with the appended drawings. For the purpose of illustrating the invention, there is shown in the drawings embodiments which are presently preferred. It should be understood, however, that the invention is not limited to the precise arrangement and instrumentality's shown. In the drawings.

DETAILED DESCRIPTION OF THE INVENTION

Figure 1:
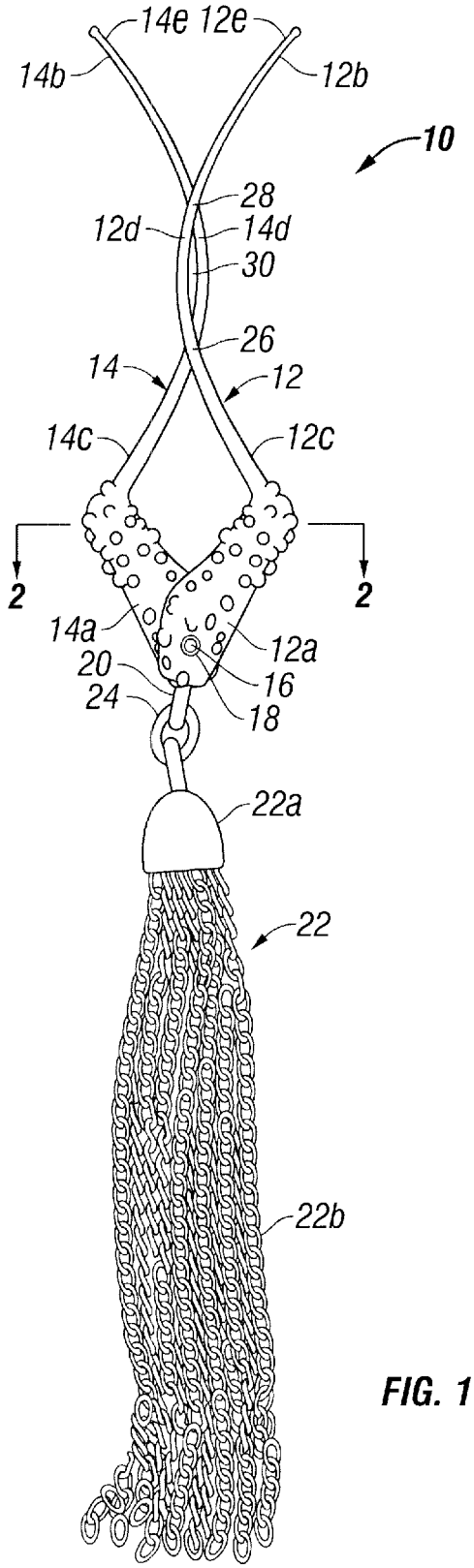
FIG. 1 is a top plan view of a body ornament in accordance with a first preferred embodiment of the present invention.

Certain terminology is used in the following description for convenience only and is not limiting. The words "right", "left", "lower" and "upper" designated directions in the drawings to which reference is made. The words "inwardly" and "outwardly" refer to directions towards and away from, respectively, the geometric center of the body ornament and designated parts thereof. The terminology includes the words noted above as well as derivatives thereof and words of similar import.

Referring now to the drawings in detail, wherein like numerals indicate like elements throughout there is shown in FIGS. 1 through 4, a body ornament, generally designated 10, in accordance with the first preferred embodiment of the present invention. The body ornament 10 includes first and second arms 12, 14, respectively, pivotally connected together at a first end 12*a*, 14*a*. The first end 12*a*, 14*a* of each of the first and second arms 12, 14, is generally trough shaped or U-shaped in cross section, for reasons described hereinafter. The first ends 12*a*, 14*a* have a decorative external surface to provide the body ornament 10 with a pleasing overall appearance. The pintle 16 extends through a correspondingly sized hole in a terminal portion of the first ends 12*a*, 14*a* of the first and second arms 12, 14. The pintle 16 permits the first and second arms 12, 14 to pivot with respect to each other. The pintle 16 includes a bolbus end 18 which prevents the pintle 16 from passing through the hole in the first ends 12*a*, 14*a* of the first and second arms 12, 14. The bolbus end 18 could be flat without departing from the spirit and scope of the invention.

Figure 3:
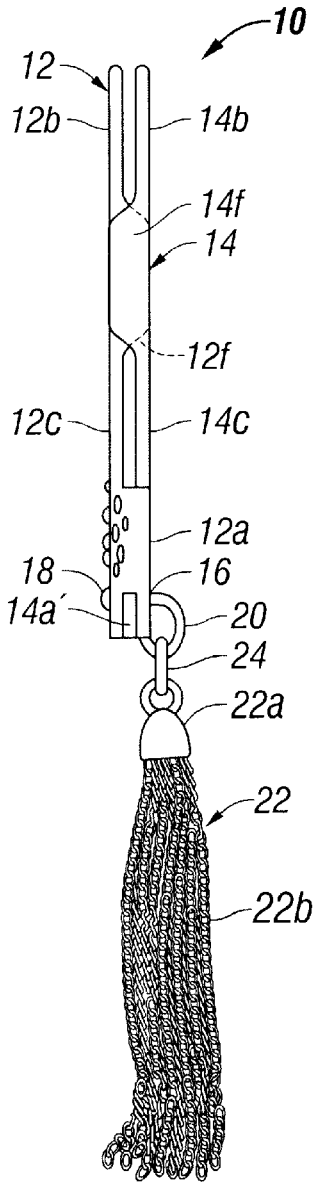
FIG. 3 is a right side elevational view of the body ornament show in FIG. 1.

The pintle 16, opposite from the bolbus end 18, extends outwardly from the first and second arms 12, 14 and forms a loop 20 for receiving a decorative item 22 to thereby hang the decorative item 22 from the body ornament 10. The present invention is not limited to any particular type of decorative item being connected to the body ornament 10. Other decorative items include those disclosed in U.S. Pat. No. 6,082,138, which is hereby incorporated by reference in its entirety. The decorative item shown in FIGS. 1 and 3 is in the form of a spherical top portion 22*a* having a plurality of decorative chains 22*b* extending therefrom. The spherical top portion 22*a* is connected to the loop 20 in any standard jewelry connecting fashion, well understood by those skilled in the art. In the first preferred embodiment, the decorative item 22 is connected to the loop 20 by loops 24. It is also understood by those of ordinary skill in the art from this disclosure, that the present invention is not limited to attaching a decorative item 22 to the body ornament 10. That is, the body ornament 10 can be used without attaching a decorative item 22 thereto.

Referring now to FIG. 1, the first ends 12*a*, 14*a* of the first and second arms 12, 14 are oriented with respect to each other such that they are generally V-shaped in plan view. In order to connect the pintle 16 between the first and second arms 12, 14, a portion 14*a*' of the first end 14*a* of the second arm 14 overlaps the first end 12*a* of the first arm 12 along the interior of the first end 12*a* of the first arm 12.

Referring now to FIGS. 1 and 3, the first and second arms 12, 14 extend upwardly from the first ends 12*a*, 14*a* in a generally overlapping curvilinear fashion to form second ends 12*b*, 14*b* of the first and second arms 12, 14. More particularly, the second ends 12*b*, 14*b* of the first and second arms 12, 14 have first portions 12*c*, 14*c* which extend generally towards each other until they reach a first cross-over point 26. The second ends 12*b*, 14*b* of the first and second arms 12, 14, have second portions 12*d*, 14*d* which extend beyond the first cross-over point 26 and curve back towards each other at a second cross-over point 28. The second portions 12*d*, 14*d* of the second ends 12*b*, 14*b* of the first and second arms 12, 14 form a generally elliptically shaped body part-receiving loop 30 for receiving a body part (not shown) therein. The body part-receiving loop 30 is adjustable in size for receiving differently sized body parts, as described in more detail hereinafter.

In the first preferred embodiment, it is preferred that the body part-receiving loop 30 receives the nipple of a human breast. However, it is understood by those of ordinary skill in the art from this disclosure, that the present invention is not limited to positioning the body ornament 10 on any particular body part and is not limited to body parts of the female species. For instance, the body part 10 could be used on male genitalia. The first and second arms 12, 14 include a third portion 12*e*, 14*e* which extends outwardly in a generally curvilinear fashion beyond the second cross-over point 28. The third portions 12*e*, 14*e* permit the body part-receiving loop 13 to be adjustable in size.

As shown in FIGS. 1 and 3, each of the second ends 12*b*, 14*b* of the first and second arms 12, 14, are generally small in cross-section having a round, square or relatively flat cross-sectional configuration, except for the second portions 12*d*, 14*d*. As best shown in FIG. 3, the second portions 12*d*, 14*d* include first and second tabs 12*f*, 14*f* which extend toward each other and are overlapping. The first and second tabs 12*f*, 14*f* spread the forces applied to the body part over a greater cross-sectional area to thereby reduce the forces applied to the body part, as described in more detail hereinafter.

Figure 2:
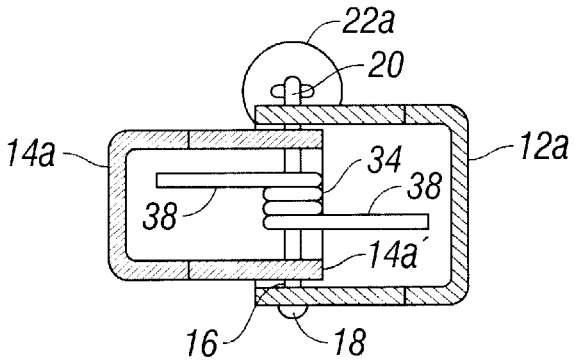
FIG. 2 is a greatly enlarged cross-sectional view of the body ornament shown in FIG. 1 taken along line 2—2 of FIG. 1.
Figure 4:
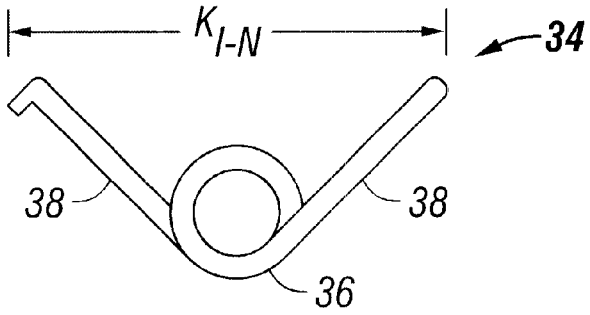
FIG. 4 is a top plan view of a coil spring used in the body ornament shown in FIG. 1.

Referring now to FIGS. 2 and 4, a biasing mechanism preferably in the form of coil spring 34 is positioned within the first ends 12*a*, 14*a* of the first arm and second arm 12, 14. More particularly, the coil spring 34 is located in the trough shaped area defined by the first ends 12*a*, 14*a* of the first and second arms 12, 14 such that the coil spring 34 is not visible in plan view. The coil spring 34 is positioned above the pintle 16, such that the pintle 16 does not extend through the coil spring 34. In the first preferred embodiment, it is preferred that a plurality of coil springs 34 having different force (k) factors be provided with the body ornament 10. In this manner, the user can select the strength of the spring positioned within the body ornament 10 to adjust the force applied by the body ornament 10 to the body part. Thus, depending on the type of body part the body ornament 10 will be attached to, the body ornament 10 can be sold as a kit having a plurality of coil springs 34 included therein each having different k factors to allow the user to select the desired forces applied by the body ornament 10 to the body part.

Although not shown, a decorative screw can be threaded into, for example, the first arm while and end of the screw contacts the second arm for preventing the body ornament 10 from flexing open.

Referring now to FIG. 4, the coil spring 34 has a coil section 36 and a pair of tangs 38 extending therefrom. One of the tangs 38 is bent at a right angle at its terminal end. The tangs 38 assist with maintaining the coil spring 34 within the first ends 12*a*, 14*a* of the first and second arms 12, 14. The tang 38 with the right angle bend facilitates removal of the coil spring 34 from the first ends 12*a*, 14*a* because it provides a space for receiving a prying instrument. The trough shaped first ends 12*a*, 14*a* are closed at their upper ends to help retain the coil spring 34 within the first ends 12*a*, 14*a*. Because the coil spring 34 pushes the first ends 12*a*, 14*a* away from each other, the second portions 12*d*, 14*d* are pushed towards each other into contact. The tabs 12*f*, 14*f* are engaged in this position to define the smallest size body part-receiving loop 30. To increase the size of the body part receiving loop 30, the user grasps the first ends 12*a*, 14*a* of the first and second arms 12, 14 and pushes them towards each other against the biased force of the coil spring 34. The body part receiving loop 30 reaches its maximum size when the first ends 12*a*, 14*a* of the first and second arms 12, 14 are positioned close together (not shown). At this point, the user positions the body part within the body part-receiving loop 30 and slowly releases the first ends 12*a*, 14*a* to allow to spring 34 to push the second portions 12*d*, 14*d* toward each until they grasp the body part (not shown).

It is understood by those of ordinary skill in the art from this disclosure that the present invention is not limited to the coil spring 34. For instance, a leaf spring or an elastomeric member (not shown) could be used without departing from the spirit and scope of the invention. Similarly, the right angle bend on the one tang 38 could be removed from the coil spring 34 without negatively impacting on the operation of the body ornament 10.

It is understood by those of ordinary skill in the art, from this disclosure, that the body ornament 10 and its respective elements are preferably constructed of precious metals, such as silver, gold or any other jewelers metal. Those of ordinary skill in the art also understand that the present invention is not limited to constructing the body ornament 10 of any particular material. For instance, the body ornament 10 could be constructed of a polymeric material, glass, wood or an edible material, such as candy, without departing from the spirit of the scope of the invention and as described in more detail hereinafter.

Figure 6:
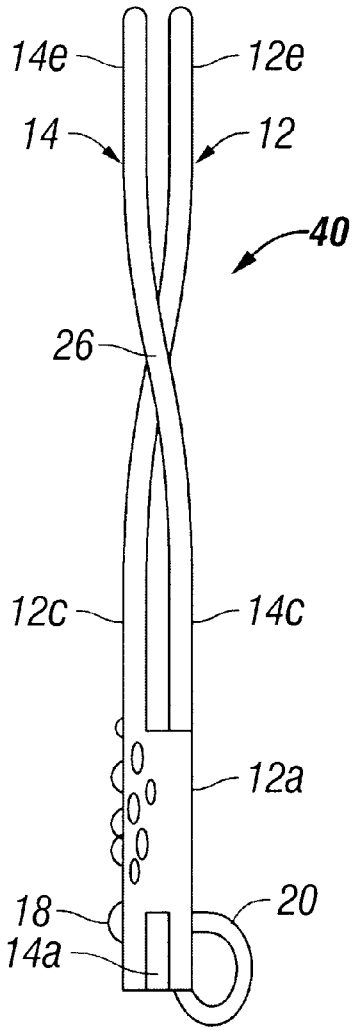
FIG. 6 is a right side elevational view of the body ornament shown in FIG. 5.
Figure 5:
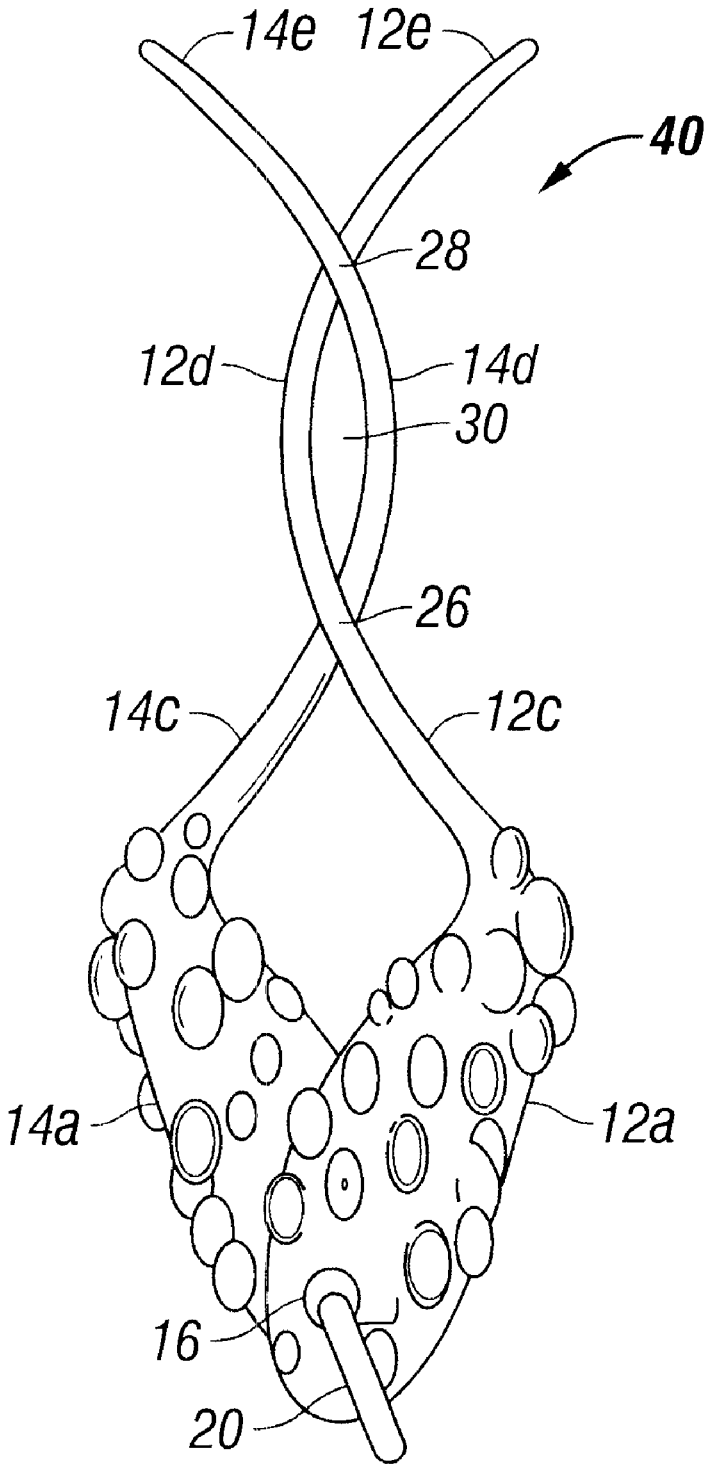
FIG. 5 is a top plan view of a body ornament in accordance with a second preferred embodiment of the invention.

Referring now to FIGS. 5 and 6, there is shown a second body ornament, generally designated 40, in accordance with a second preferred embodiment of the invention. The second body ornament 40 is generally identical to the body ornament 10 in accordance with the first preferred embodiment. Accordingly, like numerals have been used for like elements between the body ornament 10 of the first preferred embodiment and the second body ornament 40 without a complete recitation of the description of the second body ornament 40. For purposes of brevity and convenience, only the differences between the body ornament 10 in accordance with the first preferred embodiment and a second body ornament 40 will be described.

In the second body ornament 40, instead of the first and second arms 12, 14 including tabs 12*f*, 14*f* to allow the generally parallel (as viewed in FIG. 3) first and second arms 12, 14, to engage each other when the coil spring 34 forces the first ends 12*a*, 14*a* of the first and second arms 12, 14 away from each other, the first and second arms 12, 14 cross over each other generally in the form of an X, as best shown in FIG. 6. That is, the seconds ends 12*b*, 14*b* cross over each other in an opposite direction at the first and second cross over points 26, 30. At the first cross over point 26, the first arm 12 lies in front of the second arm 14. At the second cross over point 28, the second arm 14 lies in front of the first arm 12.

Figure 7:
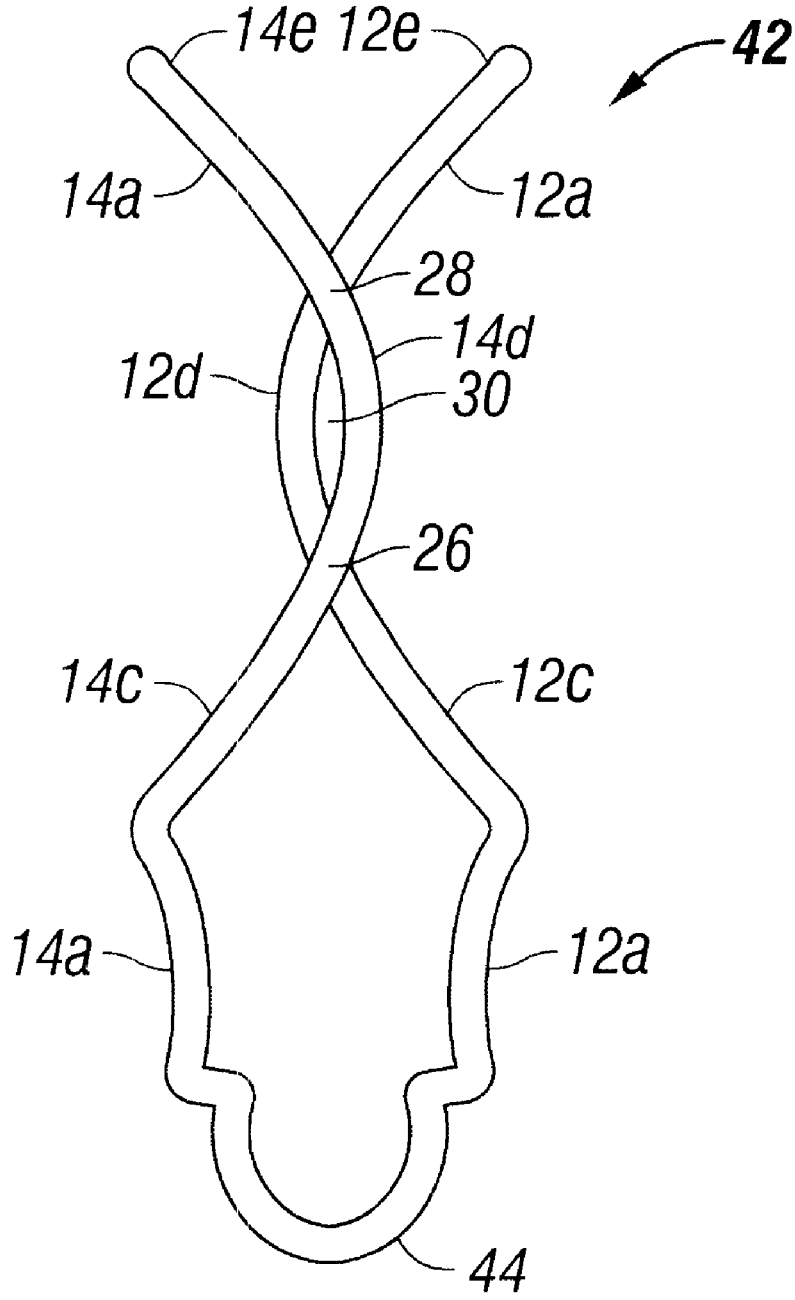
FIG. 7 is a top plan view of a body ornament in accordance with a third preferred embodiment of the invention.

Referring now to FIG. 7, there is shown a third body ornament generally designated 42, in accordance with the third preferred embodiment of the invention. The third body ornament 42 is generally identical to the body ornament 10 in accordance with the first preferred embodiment of the invention. As with the second body ornament 40, like numerals indicate like elements between the body ornament 10 in accordance with the first preferred embodiment and the third body ornament 42. Accordingly, a complete description of the third body ornament 42 is omitted for purposes of brevity and convenience only and is not limiting.

As shown in FIG. 7, except for the first ends 12*a*, 14*a* of the first and second arms 12, 14 of the third body ornament 42, the remaining portions of the third body ornament 42 are identical to the first and second arms 12, 14 of the body ornament 10 in accordance with the first preferred embodiment. Instead of connecting the first ends 12*a*, 14*a* for pivoting motion with a pintle 16, the third body ornament 42 is constructed of a polymeric material which allows the first ends 12*a*, 14*a* of the first and second arms 12, 14 to be constructed as a living hinge. The third body ornament 42 is essentially of single piece construction and is configured such that the natural resiliency of the polymeric material biases the second portions 12*d*, 14*d* of the first and second arms 12, 14 toward each other in a manner generally identical to that described above in connection the body ornament 10 in accordance with the first preferred embodiment. The biasing force applied to the second portions 12*d*, 14*d* of the first and second arms 12, 14 can be adjusted by modifying the thickness of the elements which form the first ends 12*a*, 14*a* of the first and second arms 12, 14. That is, at the lower portion of the first ends 12*a*, 14*a* of the first and second arms 12, 14, there is included a generally semicircular living hinge 44. By selecting the thickness and type of material to construct the living hinge 44 the biasing force applied by the first and second arms 12, 14 against the body part can be adjusted. Hence, the biasing force applied by the third body ornament 42 cannot be adjusted by the end user.

While the third body ornament 42 includes the tabs 12*f*, 14*f* such that the first and second arms 12, 14 extend generally parallel to each other in side view, it is understood by those of ordinary skill in the art of this disclosure that the first and second arms 12, 14 of the third body ornament 42 could be of the type described above in connection with the second body ornament 40.

The present invention is not limited to constructing the third body ornament 42 of any particular manner. The third body ornament 42 could be formed by a machining process, molding process or by hand, without departing from the spirit and the scope of the present invention.

While the third body ornament 42 is shown without a decorative item hanging therefrom, it is within the spirit and scope of the present invention to connect a decorative item, to the living hinge 44 much in the same manner that the decorative item 22 is connected to the loop 20 of the body ornament 10.

It will be appreciated by those skilled in the art that changes could be made to the embodiments described above without departing from the broad inventive concept thereof. It is understood, therefore, that this invention is not limited to the particular embodiments disclosed and is not intended to exclude known equivalents, thus it is intended to cover modifications within the spirit and scope of the present invention.

I claim:

1. A body ornament comprising:

a first positioning arm having first and second portions lying entirely on a first plane;

a second positioning arm having first and second portions lying entirely on a second plane, the second plane being different than the first plane, the first portion of the first positioning arm being connected to the first portion of the second positioning arm, the first positioning arm crossing in front of the second positioning arm at first and second crossing points;

the first and second positioning arms forming a generally elongated loop between the first crossing point and the second crossing point for receiving a body part, the second portions of the first and second positioning arms being movable between a first position wherein the loop is a first size and a second position wherein the loop is a second size which is larger than the first size, the second portions being biased toward the first position; and a first stop tab extending generally perpendicularly from the first positioning arm toward the second plane, the first stop tab being engageable with the second positioning arm for holding the second portions of the first and second positioning arms in the first position.

2. A body ornament according to claim 1, and further comprising a second stop tab extending from the second positioning arms, the first and second stop tabs being mutually engageable for holding the second portions in the first position.

3. A body ornament according to claim 1, wherein the first positioning arm is pivotally connected to the second positioning arm at a pivot joint.

4. A body ornament according to claim 3, wherein the pivot joint comprises a pivot pin that extends through the first and second positioning arms.

5. A body ornament according to claim 4, wherein the pivot pin comprises a loop for receiving a decorative item.

6. A body ornament according to claim 1, and further comprising a coil spring extending between the first and second positioning arms to thereby bias the second portions toward the first position.

7. A body ornament according to claim 6, wherein the first portions of the first and second positioning arms include a trough-shaped area, with the coil spring being located in the trough-shaped area.

8. A body ornament according to claim 1, and further comprising a plurality of interchangeable coil springs, each coil spring having a different force factor and being selectively positionable between the first and second positioning arms for biasing the second portions toward the first position under different biasing forces to thereby accommodate different user preferences.

9. A body ornament according to claim 1, wherein each positioning arm comprises a third portion that extends beyond the second crossing point from the second portion.

10. A body ornament according to claim 1, and further comprising a living hinge integrally formed with the first portions of the first and second positioning arms for pivotally connecting the first and second positioning arms together.

11. A body ornament according to claim 10, wherein the living hinge is constructed of a resilient material to thereby bias the second portions toward the first position.

12. A body ornament comprising:

a first positioning arm having first, second and third portions lying entirely on a first plane;

a second positioning arm having first, second and third portions lying entirely on a second plane, the second plane being different than the first plane, the first portion of the first positioning arm being connected to the first portion of the second positioning arm, the first positioning arm crossing in front of the second positioning arm at first and second crossing points; and the first and second positioning arms forming a generally elongated loop between the first crossing point and the second crossing point for receiving a body part, the second portions of the first and second positioning arms being movable between a first position wherein the loop is a first size and a second position wherein the loop is a second size which is larger than the first size, the second portions being biased toward the first position, with the third portions of the first and second positioning arms extending beyond the second crossing point from the second portions of the positioning arms.

13. A body ornament according to claim 12, wherein the first positioning arm is pivotally connected to the second positioning arm at a pivot joint.

14. A body ornament according to claim 13, wherein the pivot joint comprises a pivot pin that extends through the first and second positioning arms.

15. A body ornament according to claim 14, wherein the pivot pin comprises a loop for receiving a decorative item.

16. A body ornament according to claim 12, and further comprising a coil spring extending between the first and second positioning arms to thereby bias the second portions toward the first position.

17. A body ornament according to claim 16, wherein the first portions of the first and second positioning arms include a trough-shaped area, with the coil spring being located in the trough-shaped area.

18. A body ornament according to claim 12, and further comprising a plurality of interchangeable coil springs, each coil spring having a different force factor and being selectively positionable between the first and second positioning arms for biasing the second portions toward the first position under different biasing forces to thereby accommodate different user preferences.

19. A body ornament according to claim 12, and further comprising a living hinge integrally formed with the first portions of the first and second positioning arms for pivotally connecting the first and second positioning arms together.

20. A body ornament according to claim 19, wherein the living hinge is constructed of a resilient material to thereby bias the second portions toward the first position.

* * * * *